US009230388B2

(12) United States Patent
Julius et al.

(10) Patent No.: US 9,230,388 B2
(45) Date of Patent: Jan. 5, 2016

(54) FLOW WRAP HOLDER

(71) Applicant: Nice-Pak Products, Inc., Orangeburg, NY (US)

(72) Inventors: Robert P. Julius, Greenwich, CT (US); Gerard Anthony Cahalan, New Milford, CT (US); Jerry Carstens, Elmsford, NY (US); Qiuchen Peter Zhang, Ridgewood, NJ (US)

(73) Assignee: Nice-Pak Products, Inc., Orangeburg, NY (US)

( * ) Notice: Subject to any disclaimer, the term of this patent is extended or adjusted under 35 U.S.C. 154(b) by 0 days.

(21) Appl. No.: 13/830,339

(22) Filed: Mar. 14, 2013

(65) Prior Publication Data

US 2014/0263396 A1 Sep. 18, 2014

(51) Int. Cl.

| | |
|---|---|
| ***A47K 10/32*** | (2006.01) |
| ***G07F 9/10*** | (2006.01) |
| ***A47K 10/18*** | (2006.01) |
| *A47K 10/42* | (2006.01) |

(52) U.S. Cl.

CPC ..... *G07F 9/10* (2013.01); *A47K 10/185* (2013.01); *A47K 10/427* (2013.01); *A47K 2010/3266* (2013.01); *A47K 2201/00* (2013.01)

(58) Field of Classification Search

CPC . A47K 10/426; A47K 10/427; A47K 10/185; G07F 9/10

USPC ..... 221/45, 46, 226, 232; 206/494

See application file for complete search history.

(56) References Cited

U.S. PATENT DOCUMENTS

| | | | | |
|---|---|---|---|---|
| 5,531,325 | A * | 7/1996 | Deflander et al. | 206/494 |
| 7,044,329 | B2 * | 5/2006 | Lum et al. | 221/45 |
| 8,939,320 | B2 * | 1/2015 | Schiering et al. | 221/102 |
| 2004/0035738 | A1 * | 2/2004 | Julius | 206/494 |
| 2005/0194395 | A1 * | 9/2005 | Julius | 221/45 |
| 2014/0319164 | A1 * | 10/2014 | Wilson et al. | 221/45 |

* cited by examiner

*Primary Examiner* — Patrick Mackey

(74) *Attorney, Agent, or Firm* — Christie, Parker & Hale, LLP

(57) ABSTRACT

A holder assembly is provided for safely storing a package of disposable wipes and securely mounting the package of wipes to a wall or table. In one embodiment, the holder assembly has a front wall, a rear wall, and two side walls extending from a base and thereby forming a cavity for receiving the package of disposable wipes. The front wall has a guide channel for slidably receiving a lid assembly connected to the package of wipes. The base of the holder has a plurality of openings for receiving fasteners, such as button head screws or suction cups, for securing the holder to a wall or table. A rear surface of the guide channel has a plurality of ovaloid protrusions configured to engage a tab on the lid and thereby secure the lid to the holder.

18 Claims, 16 Drawing Sheets

FLOW WRAP HOLDER

TECHNICAL FIELD

This application relates generally to holder assemblies, in particular, holder assemblies adapted for safely storing a container and securely mounting the container to a wall or table.

BACKGROUND OF THE INVENTION

Disposable moist wipes for personal hygienic use are frequently found in public places, such as restrooms, restaurants, and airports, and in the home. Such wipes are typically housed within a container or package having a hinged lid portion that permits a user to remove a disposable wipe from the package. The package or container, however, is subject to damage from users, such as abrasions or tears, due to frequent and repeated use. Additionally, the package or container of wipes is typically placed on a relatively flat surface, such as a sink countertop. However, placing the package of wipes on a surface may make it more difficult or cumbersome for the user to retrieve the wipes because the user has to secure the package in place with one hand and then remove a wipe from the package with the other hand.

Accordingly, it is desirable to have a holder adapted to receive a package of dispensable wipes, wherein the holder protects the package of dispensable wipes against damage due to handling by a user and securely mounts the package of dispensable wipes to a wall or table.

SUMMARY OF THE INVENTION

The present invention is directed to a wrap holder assembly for safely storing a container, such as a package of disposable wipes, and securely mounting the container to a wall or table. In one embodiment, the assembly includes a holder having a base, a front wall, a rear wall, and two side walls. The walls extend in a first direction from the base to form a cavity configured to accommodate a container, such as a package of disposable wipes having a lid portion. The front wall has a guide channel for slidably receiving the lid of the container, and the base has a plurality of openings for receiving fasteners, such as button head screws or suction cups, for securing the holder to a wall or table. In one embodiment, a flange formed on the lid engages a front surface of the guide channel and tabs formed on the lid engage a rear surface of the guide channel. In a further embodiment, the front wall, the rear wall and the two side walls extend obliquely from the base in order to facilitate stacking multiple assemblies.

In a more detailed embodiment, the assembly includes a spring assembly mechanism for supplying a force biasing, for instance, a package of disposable wipes towards the front wall of the holder. In another embodiment, the holder has a plurality of locking pins configured to detachably secure an object, such as a package of disposable wipes, to the holder. In a further embodiment, a rear surface of the guide channel has a plurality of ovaloid protrusions configured to secure the lid to the holder. In one embodiment, the assembly includes at least one clip detachably connected to the rear wall of the holder for attaching the flow wrap holder assembly to a wall or table. In another embodiment, at least one rectangular raised portion is formed on a rear surface of the rear wall portion, wherein the raised portion is adapted to receive an adhesive material for mounting the assembly to a wall or table.

Additional aspects and/or advantages of embodiments of the present invention are set forth in the following description and accompanying drawings, or may be obvious in view thereof to those skilled in the art.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

The present invention relates to holder assemblies, in particular, holder assemblies adapted for safely storing a package of dispensable wipes and securing the package to a wall or table top. In general, the flow wrap holder is provided to accommodate a package of wipes or other articles. Additionally, the flow wrap holder is configured to be mounted to a wall or table top, although it will be appreciated that the holder could be mounted to any suitable surface. Although embodiments of the present invention are described as adapted to accommodate a container of wipes, it will also be appreciated that the holder assemblies could also accommodate other containers.

Figure 1:
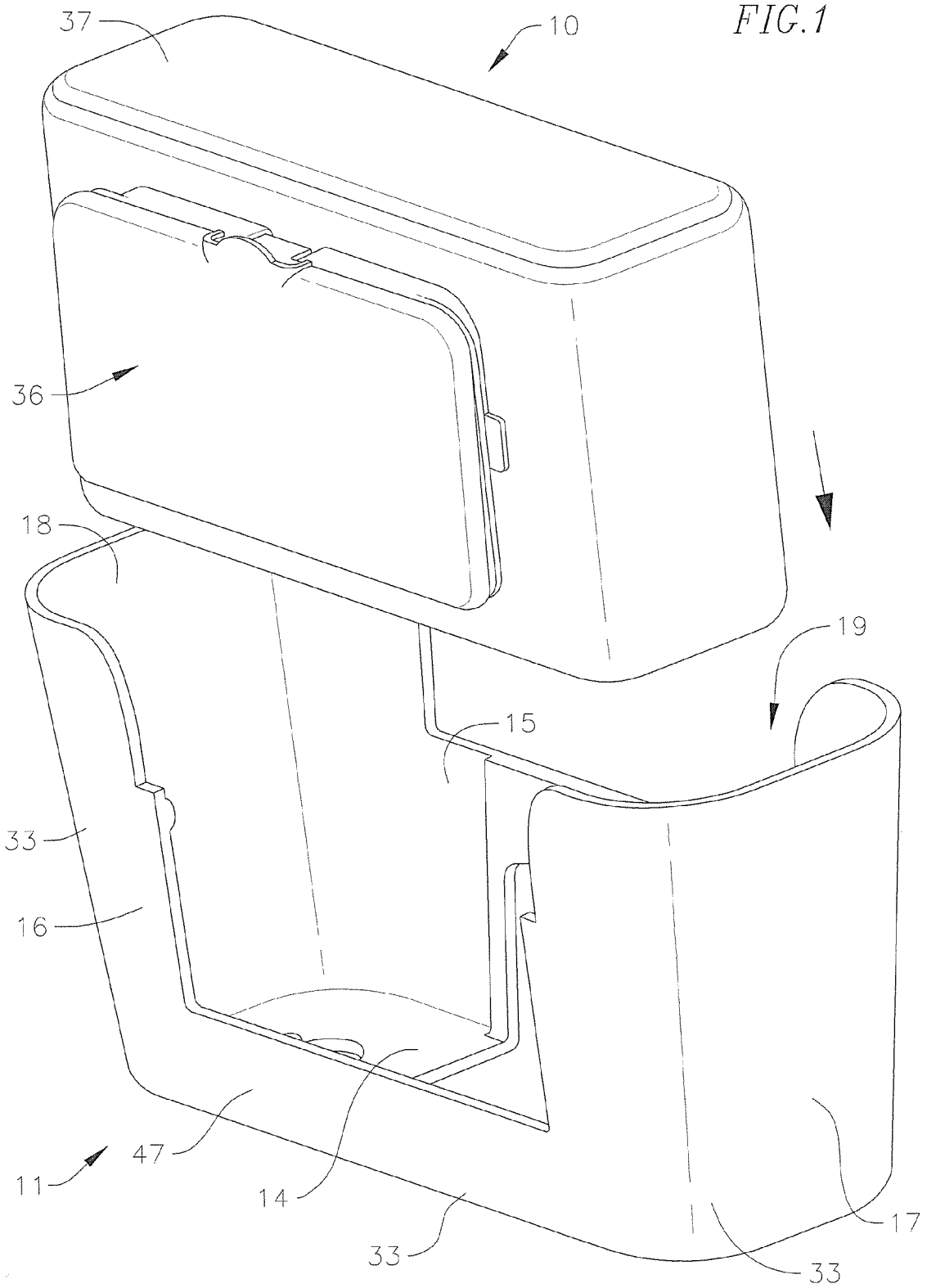
FIG. 1 is a front perspective view of an embodiment of a flow wrap holder assembly, shown with a package of dispensable wipes being inserted therein.
Figure 10:
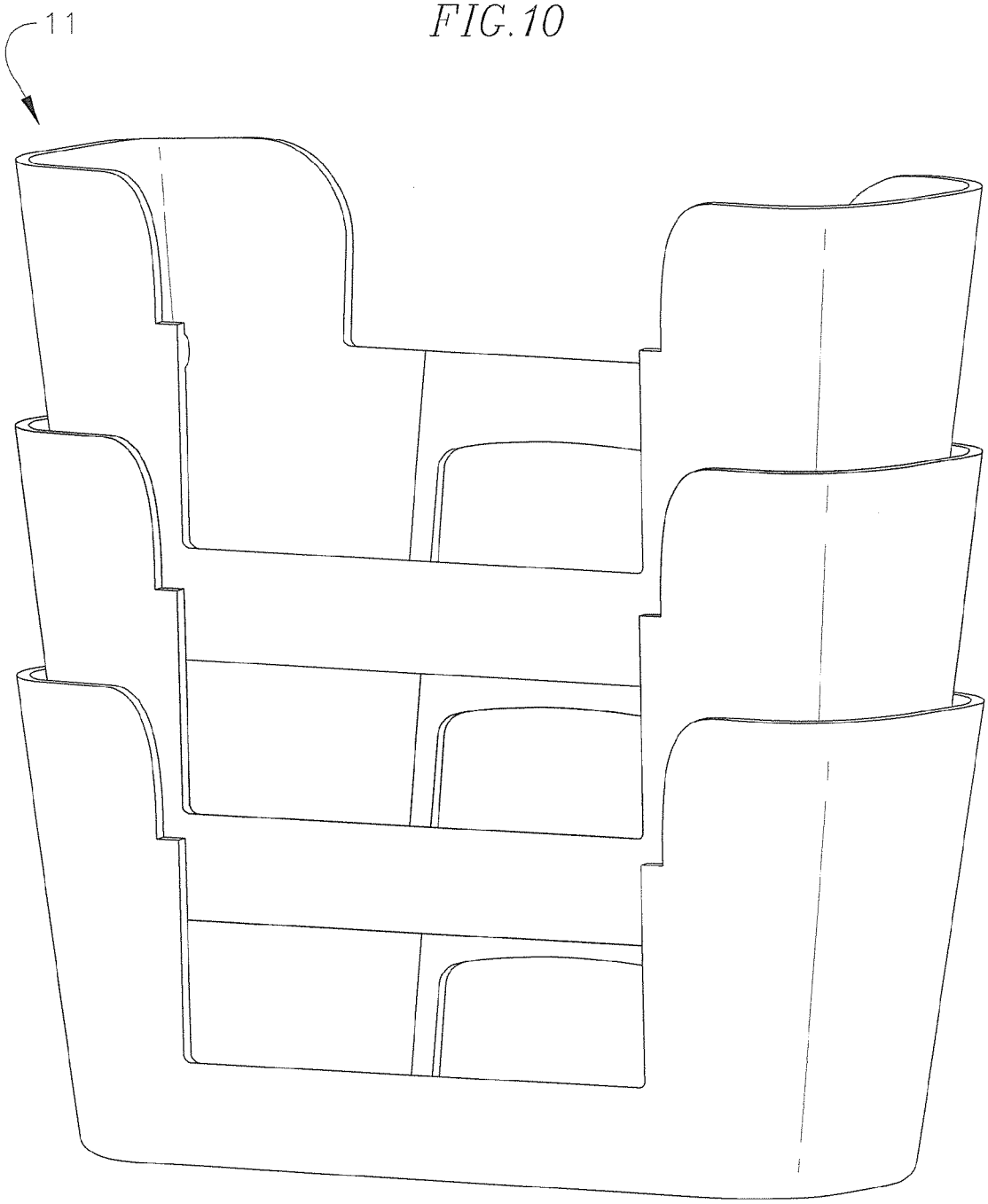
FIG. 10 is a perspective view showing several flow wrap holder assemblies in a stacked configuration.

In an embodiment of the present invention shown in FIG. 1, a flow wrap holder assembly 10 comprises a holder 11 for safely and securely holding an object, such as a package of dispensable wipes 37 connected to a lid assembly 36. As illustrated in FIGS. 1-7, the holder 11 generally includes a base 14, a rear wall 15, a front wall 16, and two side walls 17, 18. In one embodiment, the walls 15, 16, 17, and 18 project at a slight oblique angle (e.g., between about 90° and 100°) from the base 14. The slight oblique angle of the walls 15, 16, 17, and 18 relative to the base 14 facilitates stacking several flow wrap holder assemblies 10 for convenience during shipping or storage, as shown in FIG. 10. The walls 15, 16, 17, and 18 extend upward from the base 14 to form a substantially U-shaped cavity 19 for receiving the object. The walls 15, 16, 17, and 18 also form an ovaloid top opening 20 through which the package of dispensable wipes 37 can be inserted down into the cavity 19. The walls 15, 16, 17, and 18 protect the object stored in the holder 11 against damage, such as abrasions and tearing, due to handling by a user. The holder 11 can be made of any suitable material, for example, acetal plastic, polyvinyl chloride (PVC), carbon fiber reinforced polymer, or aluminum alloy that provides a generally rigid housing structure. The holder 11 may be formed from any suitable process, for example, stamping, liquid injection molding, welding, composite layering, or rapid prototyping using additive manufacturing. Additionally, it will be appreciated that although the walls 15, 16, 17, and 18 have been described as projecting at an oblique angle, the walls 15, 16, 17, and 18 could alternatively project perpendicularly with respect to the base 14 or at an acute angle. Additionally, although specific shapes of the holders 11 are shown and described, it will be appreciated that the holder may have other shapes that are consistent with the scope and spirit of the invention.

Figure 2:
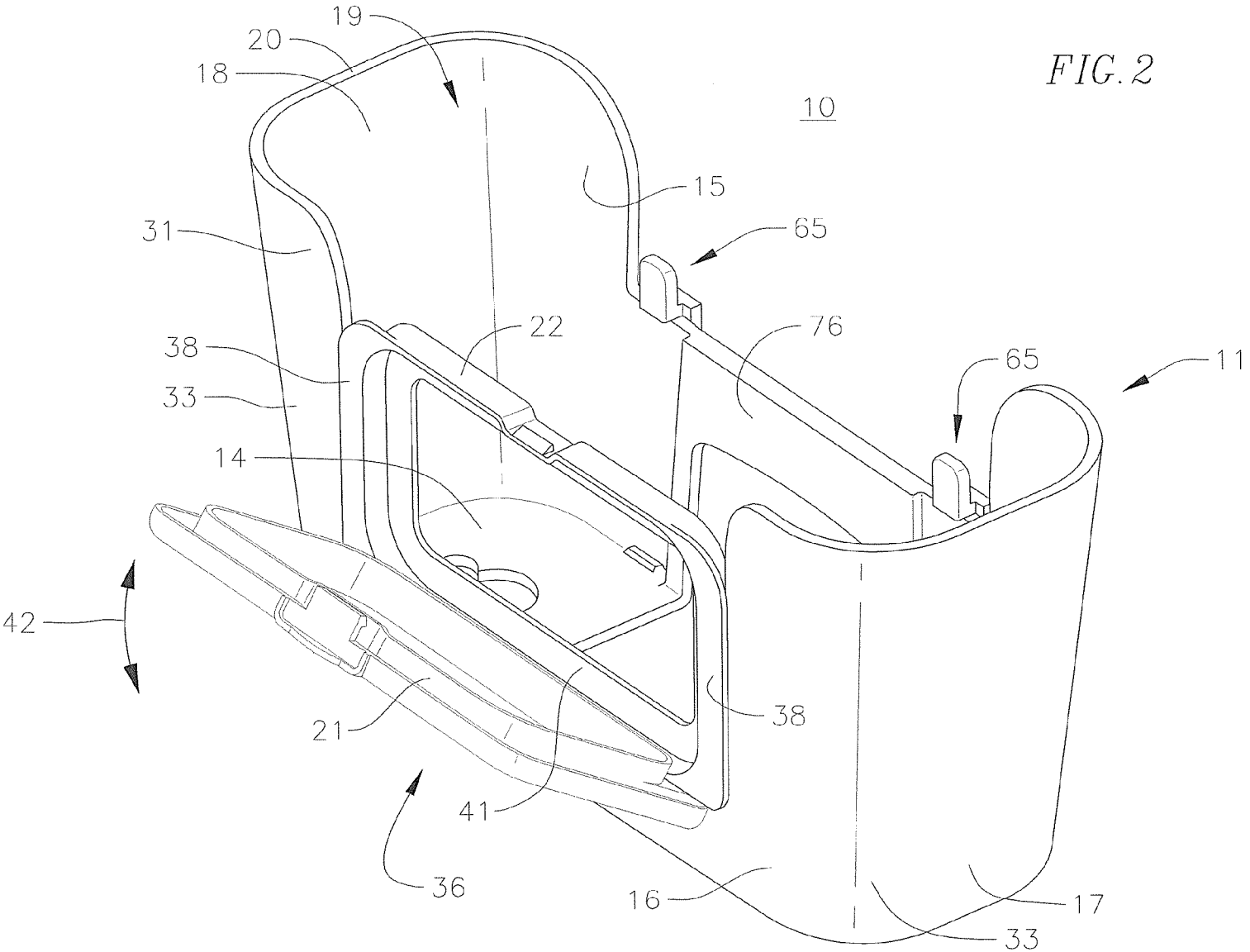
FIGS. 2 and 3 are a front perspective view and a rear perspective view, respectively, of an embodiment of a flow wrap holder assembly, shown with a lid assembly engaged to a guide channel of the flow wrap holder assembly.
Figure 3:
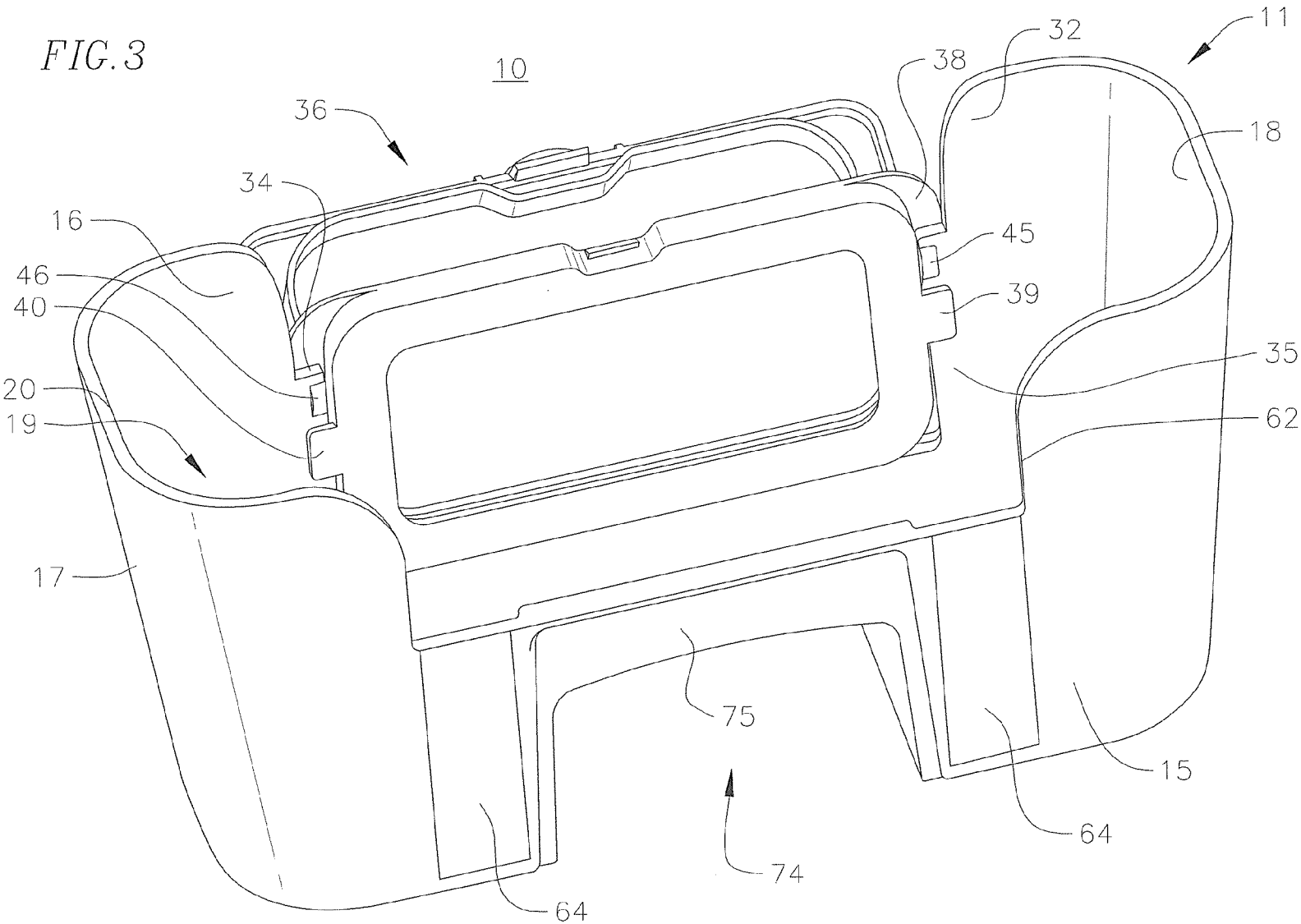
Figure 9A:
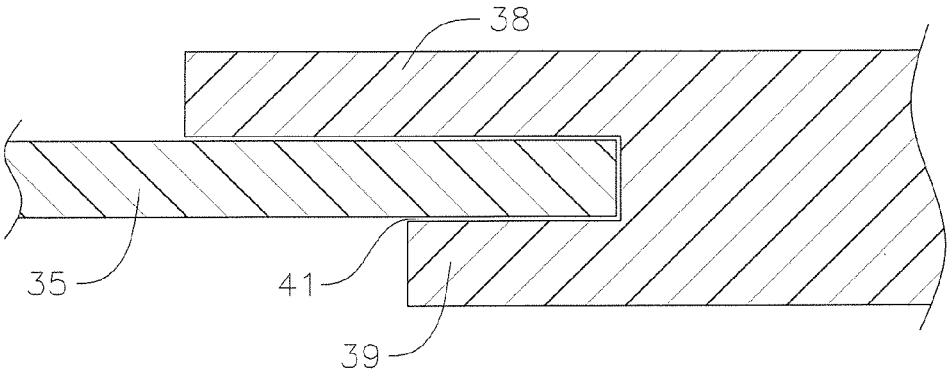
FIGS. 9A-9C are cross-sectional views of embodiments of coupling arrangements between a holder and a container of the present invention.

Referring now to FIGS. 2-3, the front wall 16 is formed from relatively thin sheet having a front surface 31 and a back surface 32. The front wall 16 also has rounded portions 33 where the front wall 16 joins the side walls 17, 18 and the base 14. The front wall 16 comprises a notched rectangular opening 34 forming a guide channel 35. The guide channel 35 extends in a direction corresponding to the sloped angle of the front wall 16 relative to the base 14. The guide channel 35 is configured to receive and secure the lid assembly 36 connected to the package of dispensable wipes 37. The lid assembly 36 has an outer lid 21 hingedly connected to an inner lid 22. The inner lid 22 has an opening 41 through which disposable wipes may be removed from the package of disposable wipes 37. An example of the lid assembly 36 is shown and described in U.S. patent application Ser. No. 13/586,734, filed Aug. 15, 2012, which is hereby incorporated by reference in its entirety. In use, a user inserts the package of dispensable wipes 37 connected to the lid assembly 36 into the cavity 19 of the holder 11 and slides the lid assembly 36 onto the guide channel 35, as illustrated in FIGS. 2, 3, and 9A. A flange 38 formed on the inner lid 22 slides along the front surface 31 of the guide channel 35 and the tab 39 formed on the inner lid 22 slides along the back surface 32 of the guide channel 35. In one embodiment, the flange 38 is formed on a front surface of the inner lid 22 and the tab 39 is formed on a rear surface of the inner lid 22 such that the flange 38 and the tabs 39 form a groove configured to be coupled to the guide channel 35. In this respect, the guide channel 35 and the lid assembly 36 act as tongue and groove joints. As will be appreciated, a similar structure is also formed by the flange 38 and another tab 40 located on the opposite side of the inner lid 22.

With continued reference to FIG. 3, in one embodiment the back surface 32 of the front wall 16 comprises two ovaloid protrusions 45, 46 extending rearward from the front wall 16. The protrusions 45, 46 are located near an upper portion of the guide channel 35 and serve as a locking mechanism preventing the lid assembly 36 from inadvertently disengaging the holder 11. After the lid assembly 36 has been slid onto the guide channel 35, the ovaloid protrusions 45, 46 engage the tabs 39, 40 formed on the lid portion 36 and thereby prevent the lid assembly 36 and the package of disposable wipes 37 from inadvertently falling out of, or otherwise becoming dislodged from, the holder 11. That is, the ovaloid protrusions 45, 46 provide a friction force which must be overcome to remove the package of dispensable wipes 37 and the lid assembly 36 from the cavity 19 of the holder 11. Additionally, the guide channel 35 is configured to engage the tabs 39, 40 formed on the lid 36 in order to retain the package 37 within the cavity 19 when a user applies a forward force, such as by removing a wipe from the package of dispensable wipes 37 through the opening 41 in the inner lid 21 or opening (arrow 42) the lid assembly 36 on the package of dispensable wipes 37. Moreover, a lower portion of the front wall 16 comprises a lip 47 (FIGS. 6A-6B) which is configured to retain the package 37 inside the cavity 19 of the holder 11. The guide channel 35 is also configured to engage the flange 38 formed on the lid assembly 36 to prevent the lid assembly 36 from falling into the cavity 19 when the user applies a rearward force, such as by closing (arrow 42) the lid assembly 36 on the package of dispensable wipes 37.

Figure 9B:
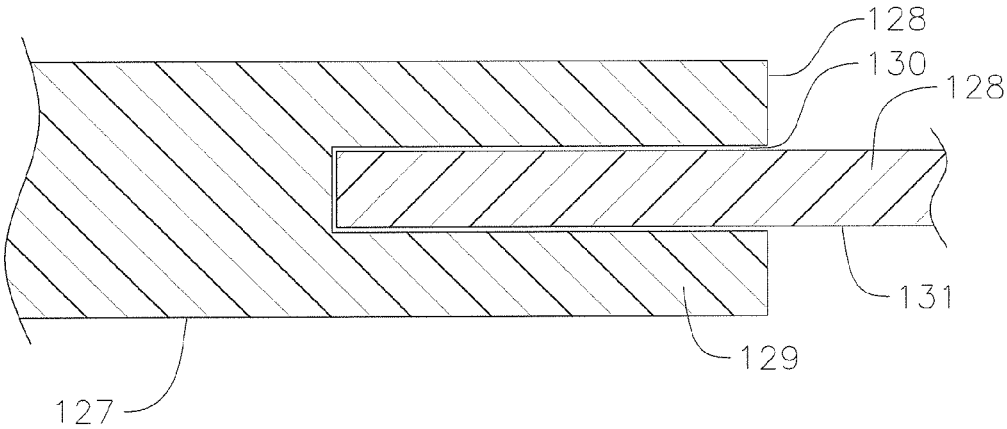
Figure 9C:
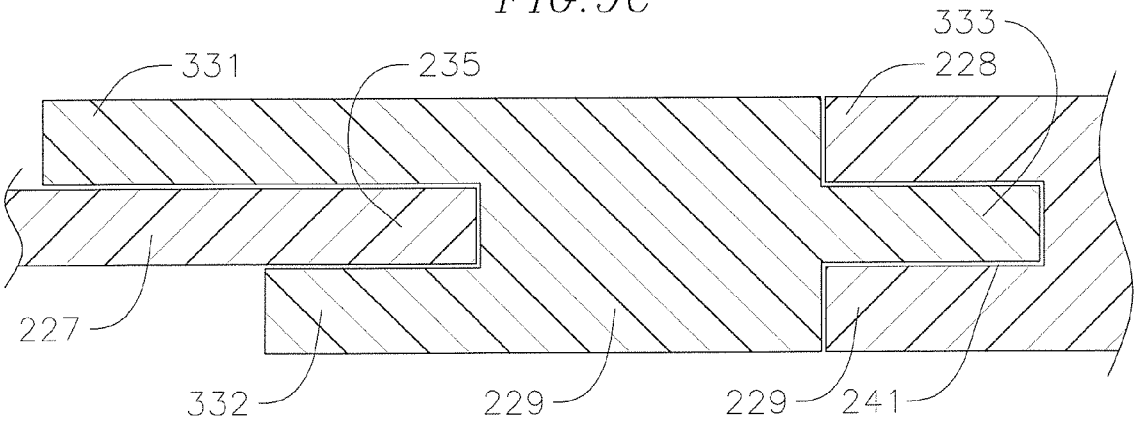

With reference now to FIGS. 9A-9C, various embodiments of a coupling between the holder and a container are shown. As noted above and shown in FIG. 9A, the guide channel 35 is located in the groove 41 between the flange 38 on the lid assembly 36 and the tab 39 located generally opposite from the flange. It will be appreciated that the lid assembly 36 can slide relatively easily along the guide channel 35, but is generally prevented from being moved in the direction of the flange 38 or the tab 39.

In another embodiment, as shown in FIG. 9B, a guide channel 127 has a forward ridge 128 extending from a forward edge of the guide channel and a rear ridge 129 extending from a rear edge of the guide channel to form a groove 130 in the guide channel rather than a groove being formed in the outer lid, as shown in FIG. 5C. As such, an outer lid 128 of the wipes package 12 need only have a single flange 131 that can be inserted between the forward ridge 128 and rear ridge 129 to hold the package within the guide channel. However, as will be appreciated, the lid assembly 26 having the flange 38 and tabs 39, 40 could also be used with the guide channel 127 having two ridges 128, 129, for instance, by locating one of the ridges 128, 129 in the groove 41 and the other one of the ridges adjacent the flange 38 or the respective tab 39, 40.

In yet another embodiment, as shown in FIG. 9C, a guide channel 227 can include one side having a single ridge 235 and a second side having a forward ridge 228 and a rear ridge 229 forming a groove 241 and similarly, an inner lid 229 can have one side having a flange 331 and a tab 332 spaced from the flange to form a groove 242 configured to receive the single ridge 235 and a second side having a flange 333 configured to fit within the groove 241.

Figure 4:
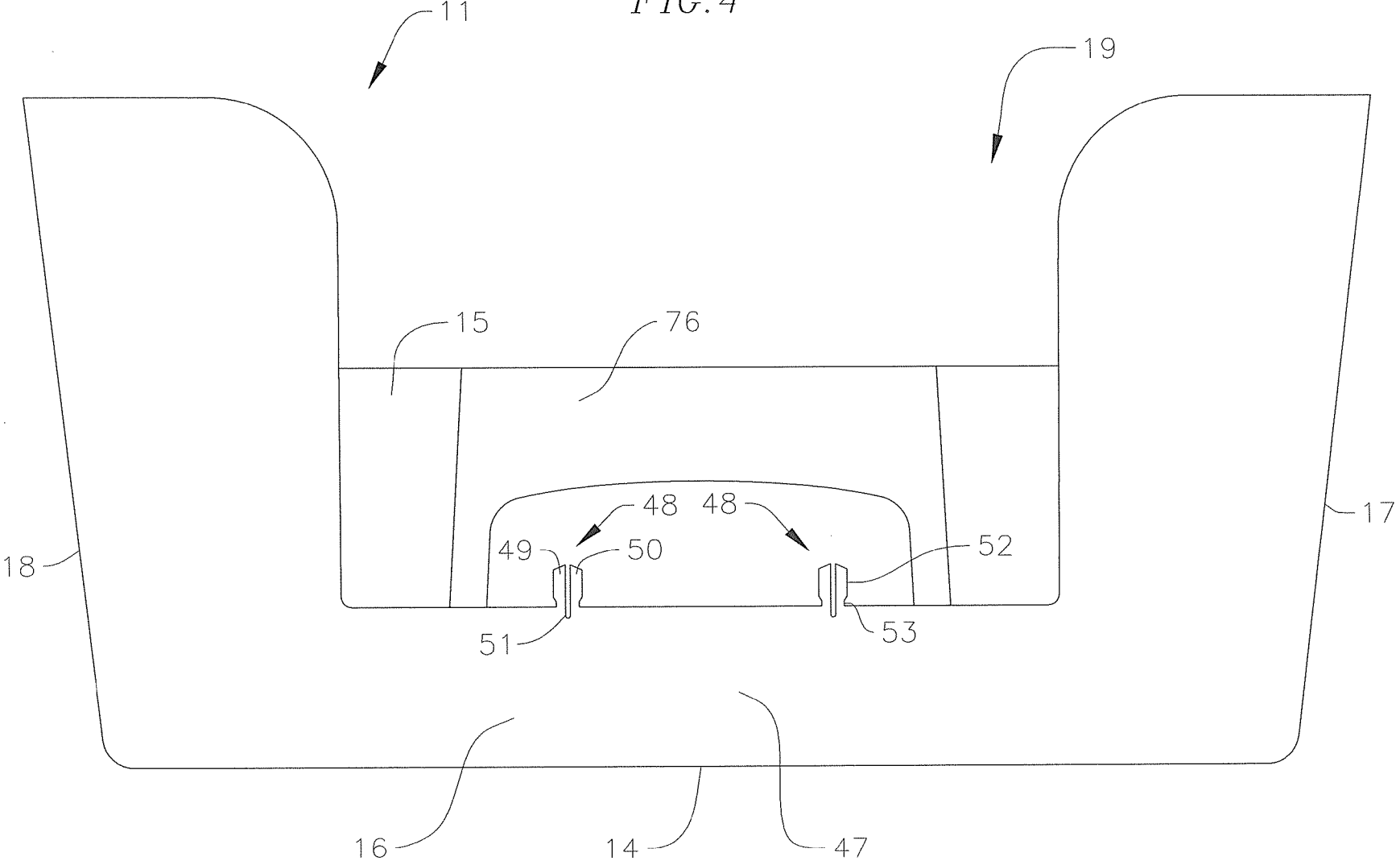
FIG. 4 is a front view of an embodiment of a flow wrap holder assembly with locking pins.

Referring now to FIG. 4, in an alternative embodiment an upper portion of the lip 47 comprises a plurality of locking pins 48 (e.g., two) designed to prevent the lid assembly 36 and the package of dispensable wipes 37 from inadvertently falling out of the cavity 19 of the holder 11. The locking pins 48 comprise a pair of prongs 49, 50 forming a relatively narrow channel 51 in between the prongs 49, 50. The prongs 49, 50 extend upward from the lip 47, and have a wider upper portion 52 that tapers to a narrower lower portion 53. The locking pins 48 are configured to be inserted into rectangular openings formed in a lower portion of the lid assembly 36 connected to the package of dispensable wipes 37. The wider upper portion 52 of the prongs 49, 50 is wider than the openings in the lid assembly 36. The narrow channel 51 is configured to permit the prongs 49, 50 to elastically deform towards each other which thereby enables the locking pins 48 to be inserted into the openings in the lid assembly 36. After the wider upper portions 52 of the prongs 49, 50 have passed through the openings in the lid assembly 36 and the narrower lower portion 53 of the prongs 49, 50 is within the opening, the restorative force supplied by the elastically deformed prongs 49, 50 causes the prongs 49, 50 to expand about the narrow channel 51. Accordingly, when the locking pins 48 are inserted into the openings in the lid assembly 36, the wider upper portion 52 of the prongs 49, 50 hangs over a peripheral portion of the openings in the lid assembly 36, which prevents the locking pins 48 from inadvertently disengaging the lid assembly 36. To detach the package of dispensable wipes 37 and the lid assembly 36 from the holder 11, a user compresses the prongs 49, 50 towards each other and then slides the locking pins 48 down and out of the openings. It is understood that the shape, configuration, and quantity of the locking pins 48 may be modified without departing from the scope of the present invention.

Figure 5:
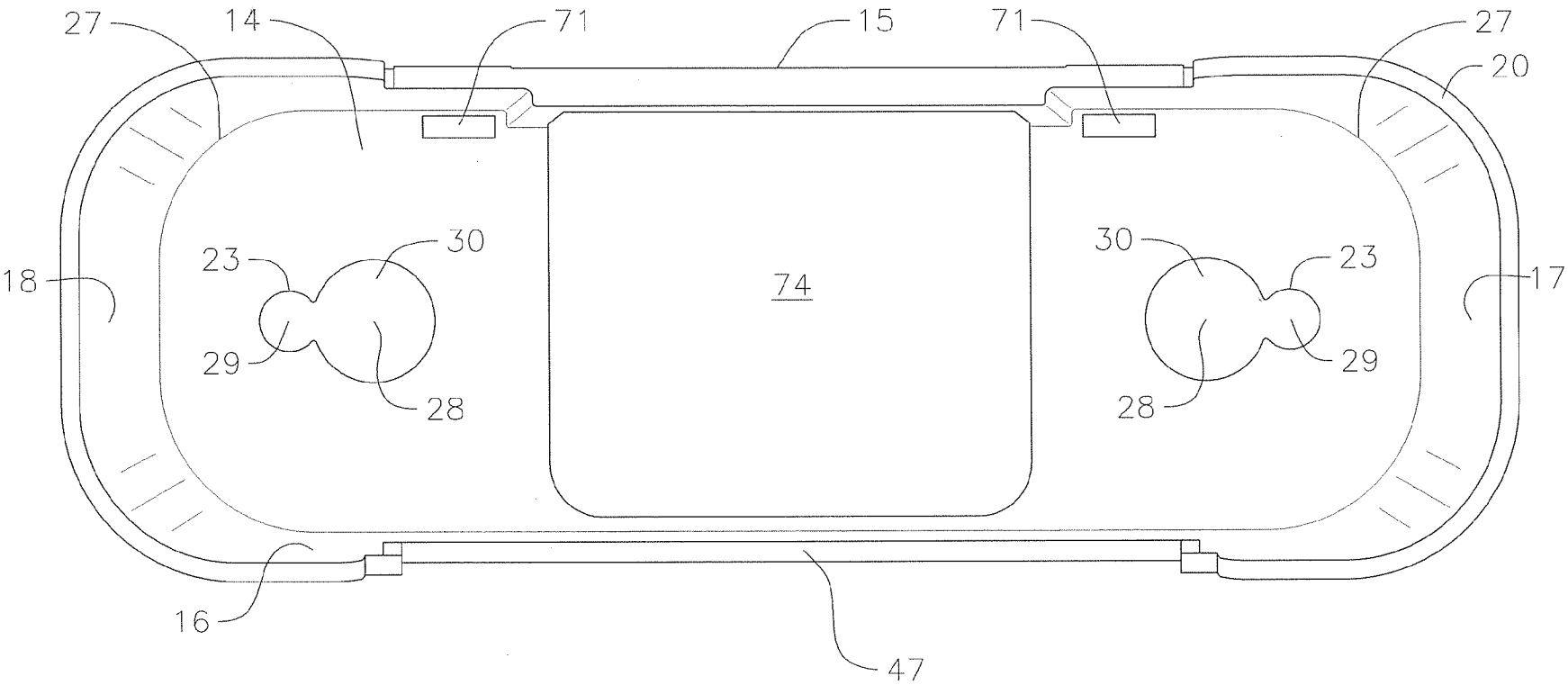
FIG. 5 is a top view of an embodiment of a flow wrap holder assembly.
Figure 6A:
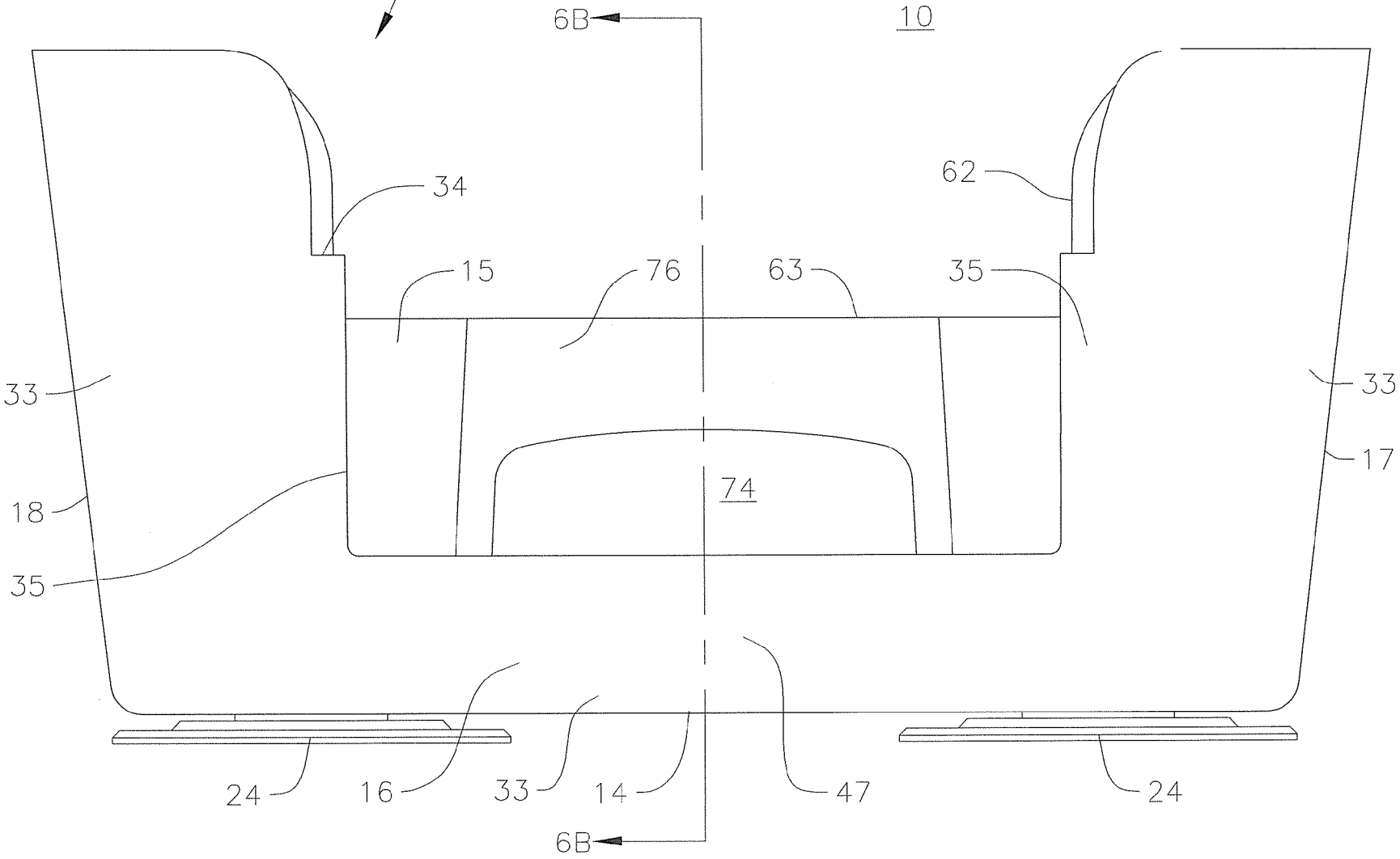
FIG. 6A is a front view of an embodiment of a flow wrap holder assembly with couplers for attaching the holder assembly to an object.
Figure 6B:
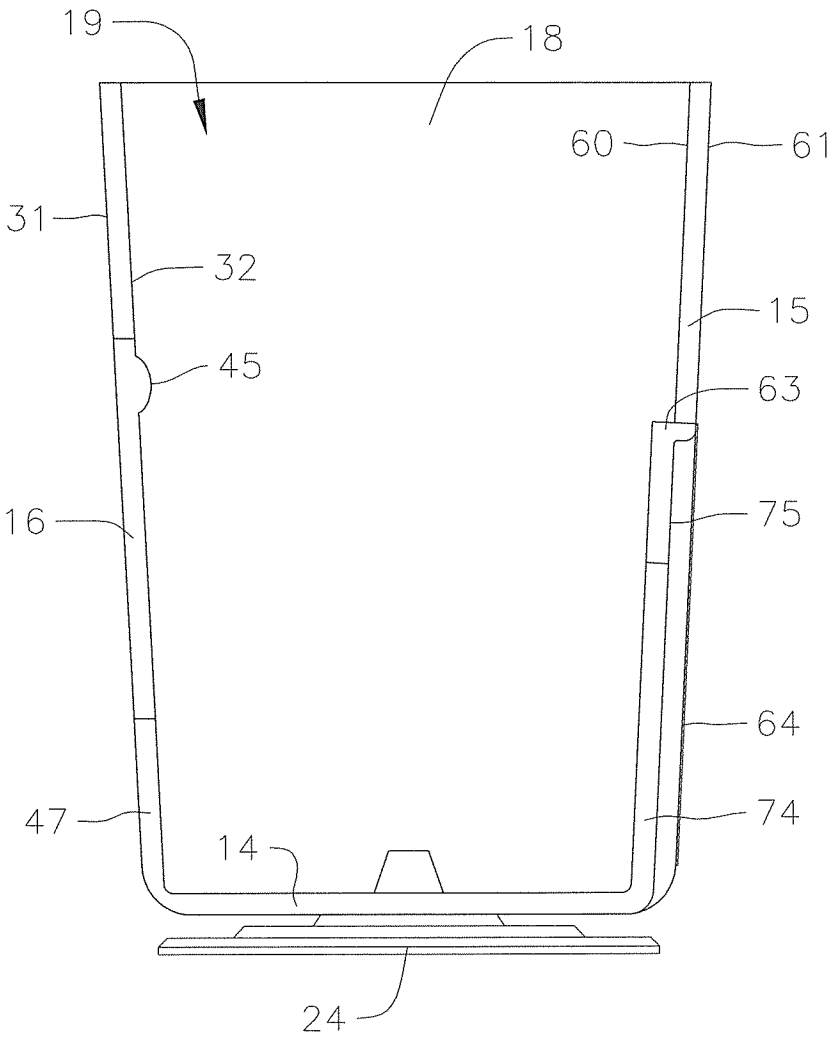
FIG. 6B is a cross-sectional view of an embodiment of the flow wrap holder assembly of FIG. 4A.

Referring now to FIG. 5, the base 14 of the holder 11 is formed from a relatively thin sheet having rounded edges and an upper surface and a lower surface. A peripheral region 27 of the base 14 is delineated by the walls 15, 16, 17, and 18 extending upward from the base 14. The base 14 includes a plurality of openings 28 (e.g., two) for receiving a plurality of fasteners, such as button head screws, to secure the flow wrap holder assembly 10 to another object, for instance, a wall or a table top. In one embodiment, the openings 28 comprise a small circular portion 29 which opens up into a large circular portion 30. In use, a user installs a fastener into a wall or table through one of the large circular portions 30 and then slides the holder 11 until the fastener engages the small circular portion 29 of the opening 28. The small circular portion 29 is configured such that a head portion of the fastener engages a peripheral portion 23 of the small circular portion 29 and thereby secures the holder 11 to the wall. In contrast, the large circular portion 30 has a diameter that allows passage of the fastener, which permits the user to remove the holder 11 from the wall or table. The user then installs the other fastener by again performing the aforementioned movements with respect to the remaining openings 28. In alternative embodiments, the shape, configuration, and quantity of the openings may be modified without departing from the scope of the present invention in order to accommodate various fasteners. In one embodiment, the openings 28 may be configured to receive a plurality of couplers 24, such as suction cups, as shown in FIGS. 6A and 6B. In another embodiment, the openings 28 may be located on another surface or surfaces, such as the rear wall 15. Additionally, the holder 11 may contain a different number of fastener openings 28, ranging between about one and four, to permit more or less refined control of the connection between the holder 11 and the wall or table by the user.

With reference now to FIGS. 6A and 6B, the rear wall 15 is formed from a relatively thin sheet having a front surface 60 and a rear surface 61. An upper portion of the rear wall 15 contains a substantially rectangular opening 62 forming a lip 63 on a lower edge of the opening 62, the significance of which will be explained below. In one embodiment, the rear surface 61 comprises a plurality of substantially rectangular raised portions 64, for example, two. The raised portions 64 are configured to receive adhesive strips for securing the holder 11 to another object, such as a wall or table.

In one embodiment, the rear wall 15 also comprises an L-shaped opening 74 configured to receive, for example, a spring assembly (see FIGS. 12-14) that biases a member away from the rear wall 15. The opening 74 extends from a mid-section of the rear wall 15 down to the base 14 and extends forward along the base 14. The rear surface 61 of the rear wall 15 comprises a recessed portion 75 surrounding a periphery of the opening 74. The recessed portion 75 permits the rear surface 61 of the rear wall 15 to rest flush against a wall or table to which the wrap holder assembly 10 is mounted, even when, for example, a spring assembly is connected to the rear wall 15 the holder 11. That is, a portion of the spring assembly is configured to be seated in the recessed portion 75 such that the rear surface 61 of the rear wall 15 may rest flush against the wall or table to which the wrap holder assembly 10 is mounted. The front surface 60 of the rear wall 15 comprises a raised portion 76 corresponding to the recessed portion 75 in order to maintain a substantially uniform wall thickness of the rear wall 15.

Figure 7:
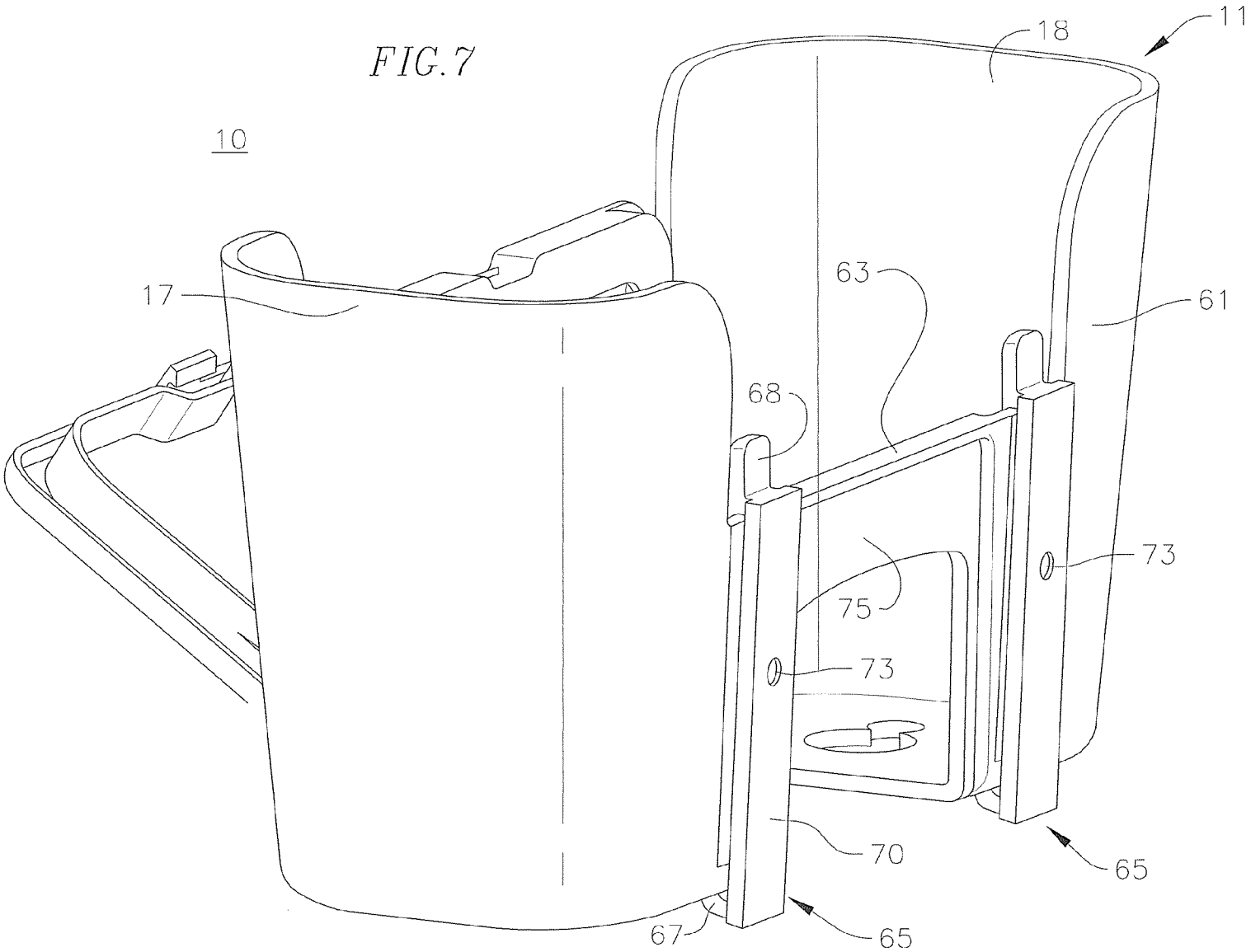
FIG. 7 is a rear perspective view of an embodiment of a flow wrap holder assembly with clips.
Figure 8:
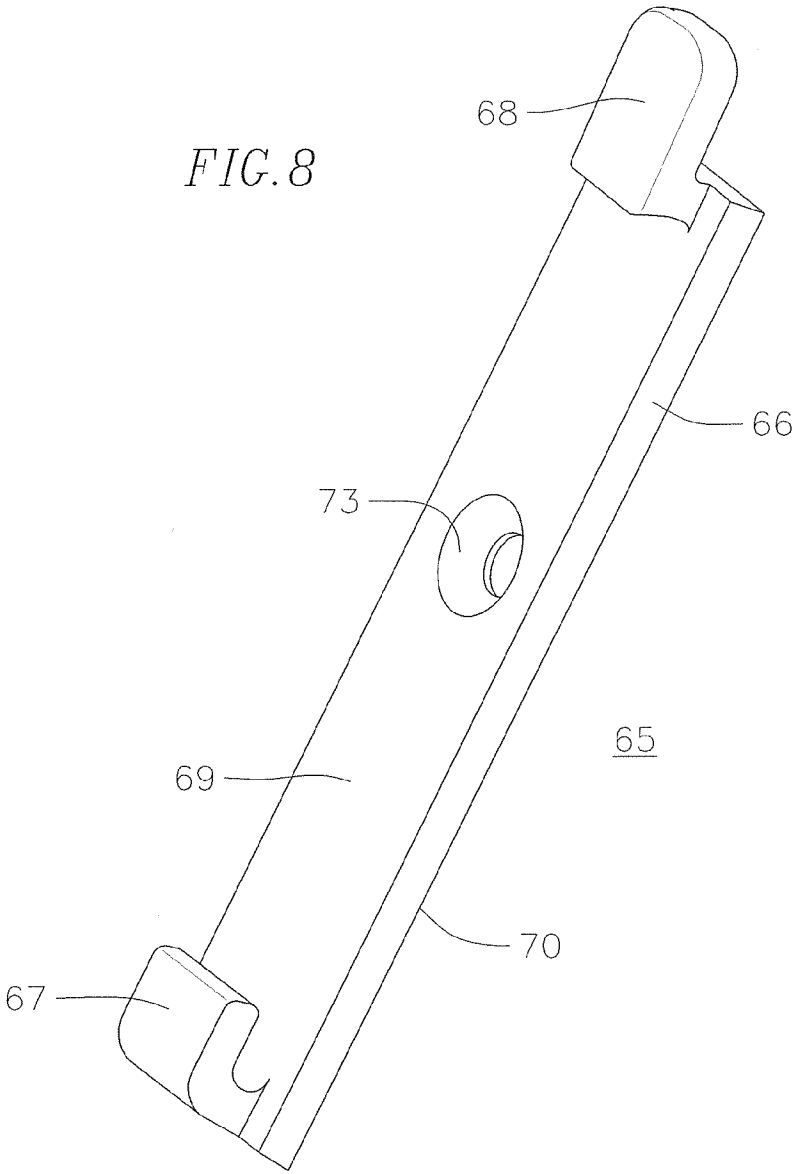
FIG. 8 is a perspective view of an embodiment of a clip.

Referring now to FIGS. 7 and 8, in an alternative embodiment, clips 65 are provided to mount the wrap holder assembly 10 to the wall or table. The clips 65 are attached to the rear wall 15 of the holder 11 and secured to the wall or table with adhesive tape and/or fasteners. The clips 65 comprise a flat, rectangular attachment portion 66, and an L-shaped hook portion 67 and a tabbed portion 68 on opposite ends of the attachment portion 66. The attachment portion 66 of the clips 65 has a front surface 69 and a rear surface 70. The hook portion 67 and the tabbed portion 68 both extend forwardly from the attachment portion 66 of the clips 65. The L-shaped hook portion 67 located on a lower end of the clip 65 is configured to attach to rectangular openings 71 (FIG. 5) in the base 14 of the holder 11. The rectangular openings 71 are located in the peripheral region 27 of the base 14 and are oriented in a lengthwise direction along the rear wall 15. The hook portion 67 of the clips 65 extends up through the rectangular opening 71 in the base 14 of the holder 11 such that the lower surface of the base 14 rests on, and is supported by, the hook portion 67 of the clip 65. The tabbed portion 68 located on an upper end of the clips 65 is configured to extend over the lip 63 in the rear wall 15 with a press-fit connection. Together, the hook portion 67 and the tabbed portion 68 of the clips 65 form a forward-facing U-shaped clamp. In this respect, the rear wall 15 of the holder 11 is clamped between the hook portion 67 and the tabbed portion 68 of the clips 65. When attached to the holder 11, the front surface 69 of the clips 65 rests flush against the rear surface 61 of the rear wall 15 of the holder 11.

With continued reference to FIGS. 7 and 8, the attachment portion 66 of the clips 65 has a countersunk hole 73 configured to accept a countersunk fastener for fastening the molded clips 65 to a wall or table. The rear surface 70 of the attachment portion 66 of the clips 65 is configured to accept an adhesive material, such as double-sided tape or double-sided adhesive pads. The clips 65 are installed to the wall or table by first applying the adhesive material to the rear surface 70 of the attachment portion 66, pressing the adhesive material onto a wall or table, and then installing the fasteners into the wall or table through the countersunk hole 73 and the adhesive material. The countersunk hole 73 and countersunk fastener permit the front surface 69 of the molded clips 65 to rest flush against the rear surface 61 of the rear wall 15 of the holder 11. In use, the molded clips 65 are first fixedly attached to a wall or table and then the holder 11 is detachably secured to the clips 65. The adhesive material applied to the rear surface 70 of the attachment portion 66 prevents the clips 65 from rotating about the fastener securing the clips 65 to the wall or table. The holder 11 is detachably connected to the clips 65 by first hooking the hook portions 67 of the clips 65 through the rectangular openings 71 in the base 14 of the holder 11 and then rotating the holder 11 until the lip 63 of the rear wall 15 "snaps" under the tabbed portion 68 of the clip 65. To detach the holder 11 from the clips 65, the aforementioned movements are performed in reverse. The clips 65 may be formed from any suitably strong and durable material, such as acetal plastic, polyvinyl chloride (PVC), carbon fiber reinforced polymer, or aluminum alloy. The clips 65 may be formed from any suitable process, for example, stamping, liquid injection molding, welding, or rapid prototyping using additive manufacturing. In an alternative embodiment, the clips 65 may contain a different number of fastener holes 73, for example two, located along the attachment portion 66. In another embodiment, the clips 66 may be provided without the adhesive material.

It is understood that the wrap holder assembly 10 may be oriented in a substantially upright position, such as when the rear wall 15 is secured to a vertical wall or the base 14 is secured to a horizontal table top, or in a substantially horizontal configuration, such as when the base 14 is secured to a vertical wall.

Figure 11A:
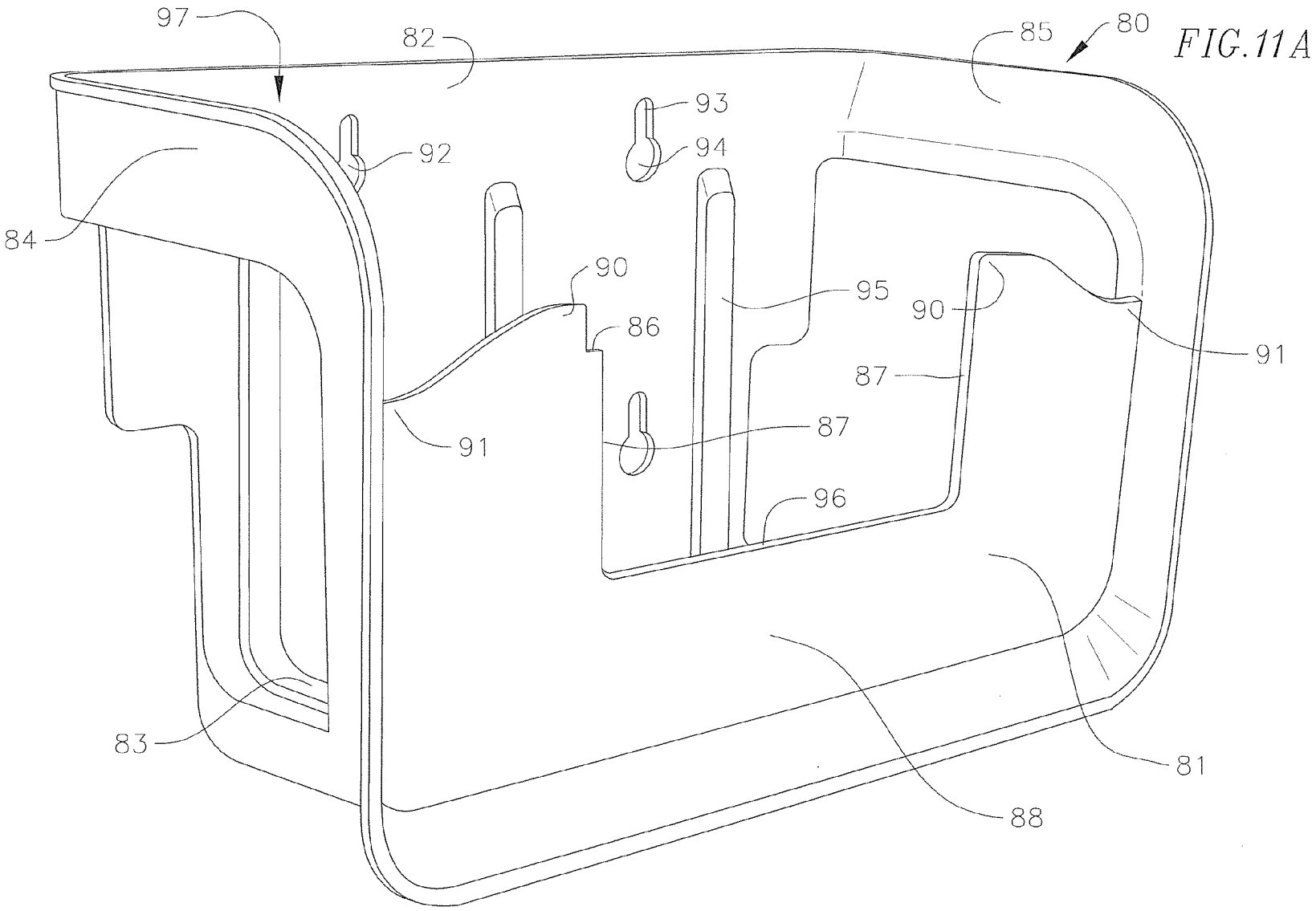
FIGS. 11A and 11B are a front perspective view and a rear perspective view, respectively, of an embodiment of a flow wrap holder assembly.
Figure 11B:
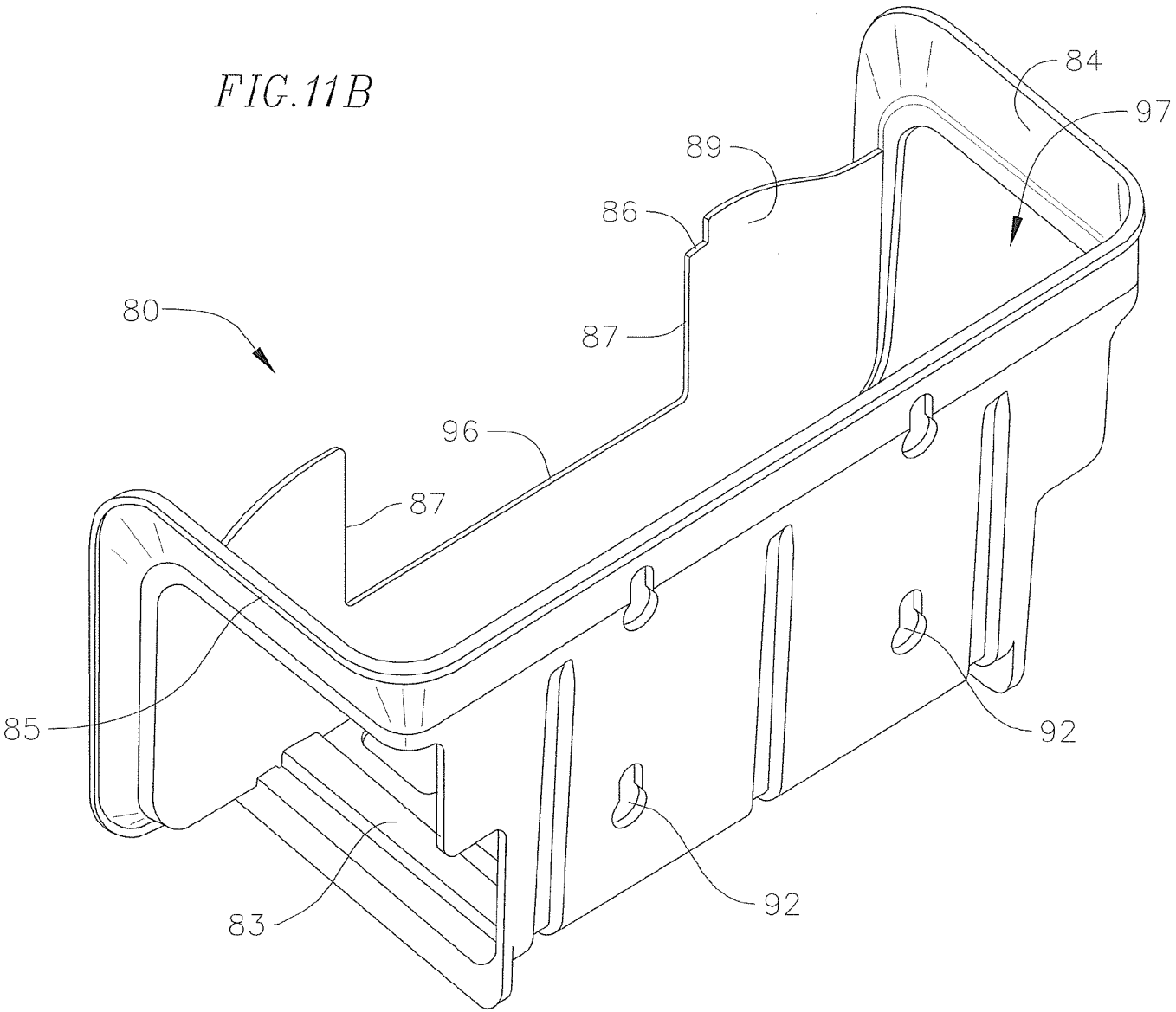

Referring now to FIGS. 11A-11B, in one embodiment the flow wrap holder assembly 10 comprises a holder 80 having a front wall 81, a rear wall 82, a base 83, and two arms 84, 85 connecting the front wall 81 to the rear wall 82. In one embodiment, the holder 80 has open side portions. The front wall 81 and the rear wall 82 extend upward from the base 83 to form a cavity 97 configured to receive an object, such as a package of dispensable wipes 37. The walls 81, 82 and the arms 84, 85 also form a top opening through which the package of dispensable wipes 37 can be inserted down into the cavity 97. The walls 81, 82, the arms 84, 85, and the base 83 protect the object stored in the holder 80 against damage, such as abrasions and tearing, due to handling by a user.

With continued reference to FIGS. 11A-11B, the front wall 81 is formed from relatively thin sheet having a front surface 88 and a back surface 89. Similar to the front wall described above, the front wall 81 includes a notched rectangular opening 86 forming a guide channel 87. The guide channel 87 is configured to receive and secure the lid assembly 36 connected to the package of dispensable wipes 37. In use, a user inserts the package of dispensable wipes 37 connected to the lid assembly 36 down into the cavity 97 of the holder 80 and slides the lid assembly 36 onto the guide channel 87. The flange 38 formed on the inner lid 22 slides along the front surface 88 of the front wall 81 and two tabs 39, 40 formed on the inner lid 22 slide along the back surface 89 of the from wall 81. In one embodiment, the flange 38 is formed on a front surface of the inner lid 22 and the tabs 39, 40 are formed on a rear surface of the inner lid 22 such that the flange 38 and the two tabs 39, 40 form a groove configured to be coupled to the guide channel 87. In this respect, the guide channel 87 and the lid assembly 36 act as tongue and groove joints. Additionally, the guide channel 87 is configured to engage the tabs 39, 40 formed on the lid assembly 36 in order to retain the package 37 within the cavity 97 when a user applies a forward force, such as by removing a wipe from the package of dispensable wipes 37 or opening the lid assembly 36 on the package of dispensable wipes 37. Moreover, a lower portion of the notched rectangular opening 86 forms a lip 96 in the front wall 81 which is configured to retain the package 37 inside the cavity 97 of the holder 80. The guide channel 87 is also configured to engage the flange 38 formed on the lid assembly 36 to prevent the lid assembly 36 from falling into the cavity 97 when the user applies a rearward force, such as by closing the lid assembly 36 on the package of dispensable wipes 37. Additionally, in one embodiment an upper edge of the front wall 81 has taller inner portions 90 that taper to shorter outer portions 91. Said another way, the upper edge of the front wall 81 is scalloped such that the front wall 81 is tallest where the front wall 81 meets the guide channel 87 and is shortest at the outer edges of the front wall 81.

Still referring to FIGS. 11A-11B, the rear wall 82 is formed from a relatively thin sheet having a front surface and a rear surface. In one embodiment, the rear wall 82 includes a plurality of openings 92 (e.g., four) configured to receive a plurality of fasteners, such as button head screws, to secure the flow wrap holder assembly 10 to another object, for instance, a wall or a table top. In one embodiment, the openings 92 are keyhole-shaped and have a small ovaloid portion 93 which opens up into a large circular portion 94. In use, a user installs a fastener into a wall or table through one of the large circular portions 94 and then slides the holder 80 down until the fastener engages the small ovaloid portion 93 of the opening 92. The small ovaloid portion 93 is configured such that a head portion of the fastener engages a peripheral portion of the small ovaloid portion 93 and thereby secures the holder 80 to the wall. In contrast, the large circular portion 94 of the opening 92 has a diameter that allows passage of the fastener, which permits the user to remove the holder 80 from the wall or table. The user then installs the other fasteners by again performing the aforementioned movements with respect to the remaining openings 92. In alternative embodiments, the shape, configuration, and quantity of the openings 92 may be modified without departing from the scope of the present invention in order to accommodate various fasteners.

In one embodiment, the front surface of the rear wall 82 includes a plurality of vertically oriented protrusions 95 (e.g., ranging between about two and five), as shown in FIG. 11A. The protrusions are configured to supply a frictional force which resists the package of disposable wipes 37 from inadvertently falling out of the cavity 97 of the holder 80. Additionally, the protrusions 95 are configured to prevent contact between the fasteners securing the holder 80 to the wall or table and the package of disposable wipes 37 housed in the cavity 97. That is, the thickness of the protrusions 95 is greater than the head height of the fasteners securing the holder 80 to the wall or table in order to prevent the fasteners from contacting the package of disposable wipes 37, which contact might otherwise damage or prematurely wear the package of disposable wipes 37. In alternative embodiments, the shape, configuration, and quantity of the protrusions 95 may be modified without departing from the scope of the present invention.

With continued reference to FIGS. 11A-11B, in one embodiment the holder 80 includes a plurality of arms 84, 85 (e.g., two) configured to connect an upper portion of the rear wall 82 to an upper portion of the front wall 81. The arms 84, 85 are located on opposite ends of the holder 80 and comprise a relatively thin band or strip. In one embodiment, the arms 84, 85 extend forward from an upper portion of the rear wall 82 to an upper portion of the front wall 81, down along the outer edges of the front wall 81, and across the lower edge of the front wall 81 where the two arms 84, 85 join. In one embodiment, the arms 84, 85 form an oblique angle (e.g., between about 95° and 150°) with the front wall 81. Additionally, it will be appreciated that although the arms 84, 85 have been described as projecting at an oblique angle from the front wall 81, the arms 84, 85 could alternatively project perpendicularly with respect to the front wall 81 or at an acute angle. The arms 84, 85 are configured to prevent the package of disposable wipes 37 housed in the cavity 97 from inadvertently falling out of the open side portions of the holder 80 and to provide increased structural rigidity to the holder 80.

The holder 80 can be made of any suitable material, for example, acetal plastic, polyvinyl chloride (PVC), carbon fiber reinforced polymer, or aluminum alloy that provides a generally rigid housing structure. The holder 80 may be formed from any suitable process, for example, stamping, liquid injection molding, welding, composite layering, or rapid prototyping using additive manufacturing.

Figure 12:
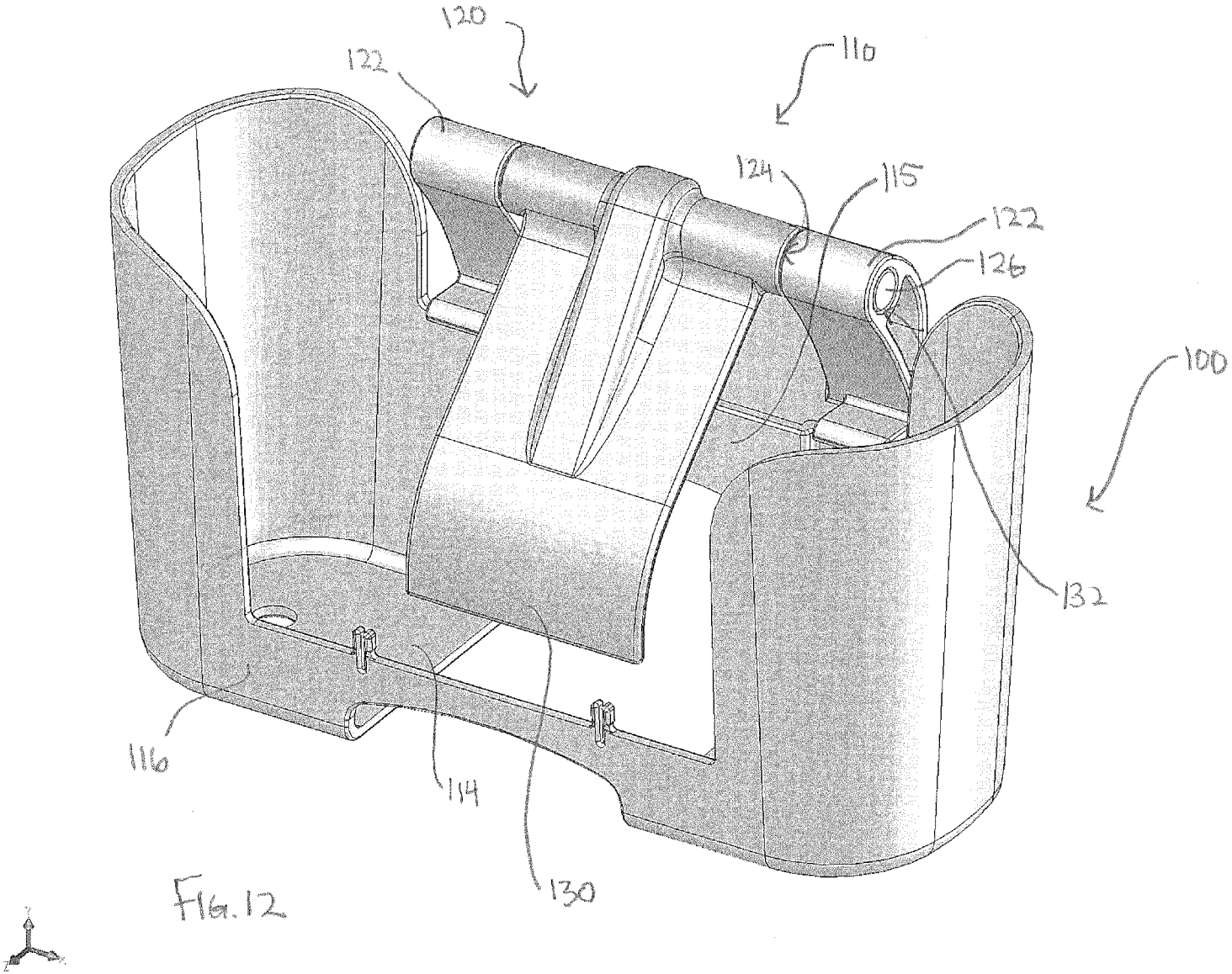
FIG. 12 is a front perspective view of an embodiment of a flow wrap holder assembly having a biasing element.
Figure 13:
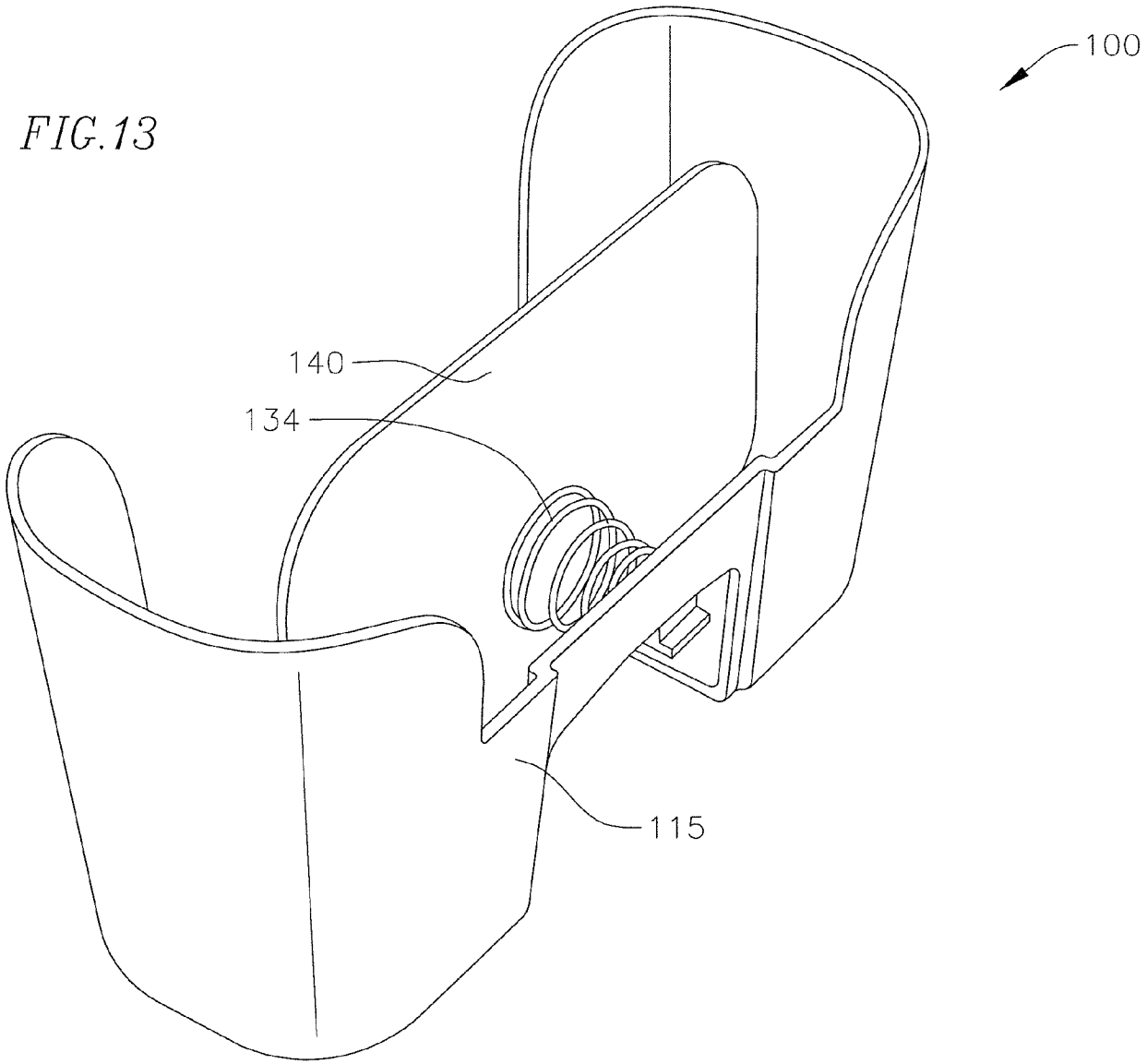
FIG. 13 is a rear perspective view of another embodiment of a flow wrap holder assembly having a biasing element.
Figure 14:
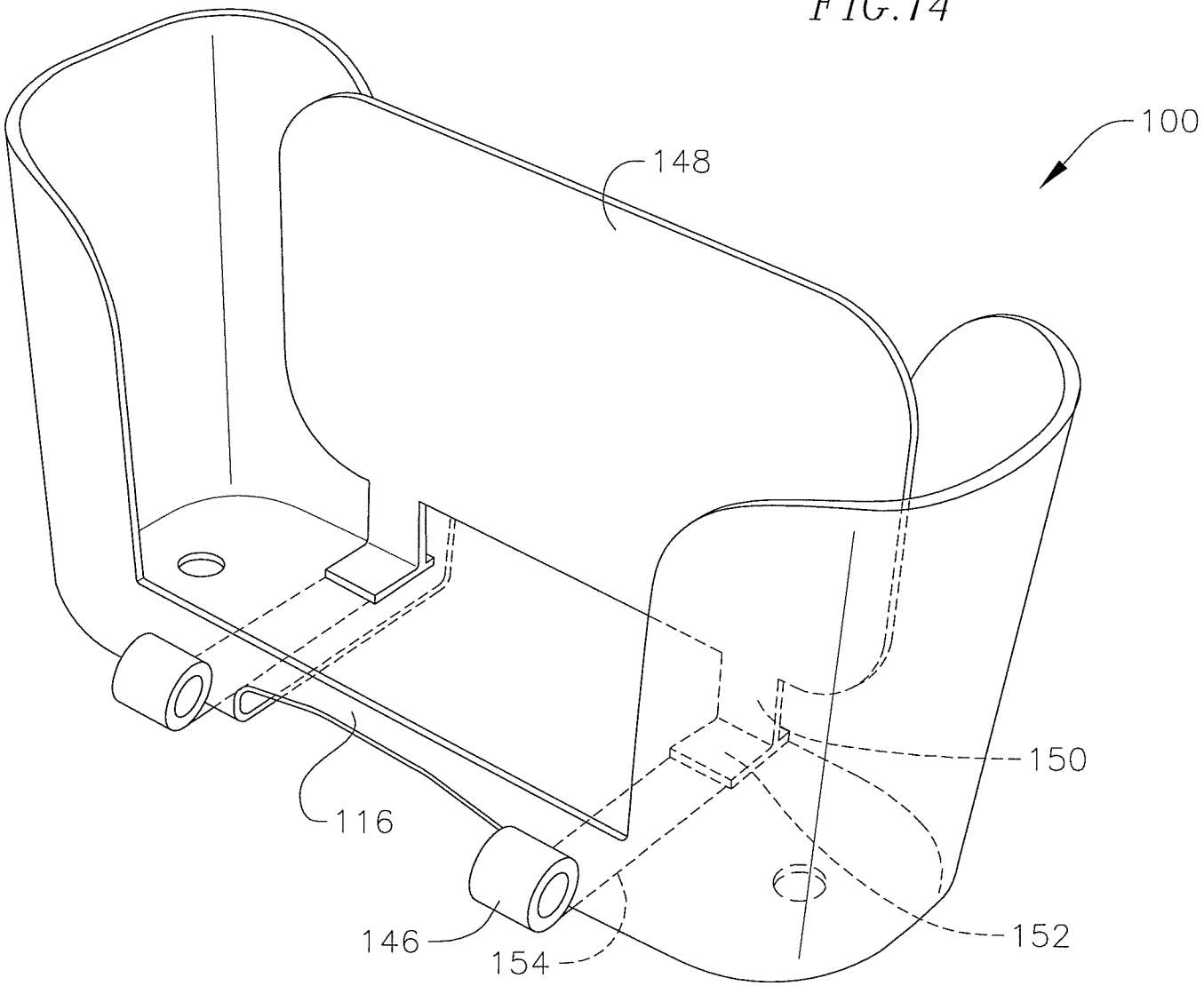
FIG. 14 is a front perspective view of another embodiment of a flow wrap holder assembly having a biasing element.

With reference now to FIGS. 12-14, other embodiments of a holder 100 of the present invention are shown. As will be appreciated, the holder 100 of these embodiments has a structure similar to the holders of other embodiments described above, with the differences being emphasized below.

As shown in the figures, the holder 100 includes a base 114 and a wall structure as described with respect to previous embodiments, including a rear wall 115 and a front wall 116. As will be appreciated, any of the configurations of the guide channel and other aspects of previously described holders as shown herein could be adopted into the holder 100 of the present embodiment. In general, the holder of FIGS. 12-14 has been configured with a spring assembly to provide a biasing force as described in more detail below.

With reference to FIG. 12, the holder 100 includes a spring assembly 110 which provides a biasing force generally from the rear wall 115 to the front wall 116. Accordingly, when wipes, a package of wipes, or other objects are inserted into the holder 100, the spring assembly 110 biases such objects against the front wall 116, making them more accessible and easier to remove from the holder.

As shown in the figure, the spring assembly 110 includes a support structure 120 and an arm 130 rotatably coupled to the support structure. In one embodiment, the support structure includes two support brackets 122 having a channel 124 configured to receive a rod 126. The arm 130 includes a generally planar or flat surface that can apply a biasing force to objects in the holder 100 and a channel 132 at a proximal end thereof to allow rotation of the arm with respect to the support structure 120. The channels 124, 132 of the support structure 120 and the arm 130, respectively, can be aligned and the rod 126 can be inserted through the channels. Additionally, a torsion spring as is well-known in the art can be housed within the channel 132 to provide a biasing force to the arm 130 such that objects are forced towards the front wall 116 while allowing the arm to be rotatable with respect to the support structure 120. In one embodiment, the support structure 120 may also be rotatable about the rear wall 115 such that as objects are removed from the holder 100, the support structure rotates towards the front wall 116.

With reference now to FIG. 13, the holder 100 in another embodiment includes a spring 138 coupled to a generally planar plate 140 to bias the plate towards the front wall of the holder. The spring 138 may be mounted directly or indirectly to the rear wall 115 opposite the front wall and the spring may be, for example, a cylindrical or conical compression coil spring. In other embodiments, the spring 138 may be made from a resilient foam material that has biasing characteristics similar to a spring. More specifically, the foam may be coupled to the plate 140 in the form of slugs or rods in various locations or as a sheet covering a significant area of the plate.

With reference now to FIG. 14, in yet another embodiment, the holder 100 includes a clock spring 146 coupled to a plate 148, wherein the clock spring is coupled to the holder 100. More specifically, as shown in the figure, two clock springs 146 are coupled to the holder 100 at the front wall 116 thereof, each including a ribbon 154, wherein the clock springs are spaced from each other and oriented generally parallel to each other. Additionally, the plate 148 has a pair of legs 150 each having a foot 152 configured to slide along the bottom wall 114 of the holder 100. Each foot 152 is coupled to a ribbon 154 of a respective the clock spring 146 that biases the feet, and therefore the entire plate 148, towards the front wall 116. Because the feet 152 have a generally flat planar surface, the plate 148 can be maintained to be oriented substantially parallel to the front wall 116 despite being biased along a lower portion by the clock springs, although it will be appreciated that the feet could be omitted and that the plate 148 could have a different structure within the scope and spirit of the invention and the spring and plate system would operate as intended. Additionally, it will be appreciated that more or fewer clock springs may be used and, as shown in FIG. 14, the holder 100 may be made from a transparent or translucent material to allow greater visibility of the holder contents. Although a specific design of the biasing members and supporting structures are shown, it will be appreciated that the present invention is not limited to the specific structure shown, but rather that alternative structures may be used as well.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims.

What is claimed is:

1. A holder assembly comprising:

a holder comprising a base, a front wall, a rear wall, and two side walls, the walls extending from the base at an oblique angle to form a cavity configured to accommodate a container, the front wall having a guide channel for receiving the container, wherein the guide channel is a cut-out having two opposing side edges; and a biasing member configured to bias contents of the holder towards the front wall, the biasing member comprising a support structure and an arm rotatably coupled to the support structure.

2. The holder assembly of claim 1, wherein the guide channel has a first ridge and a second ridge spaced from and oriented generally parallel to the first ridge to form a groove therebetween.

3. The holder assembly of claim 1, wherein the two opposing side edges comprise a first edge and a second edge of the front wall of the assembly, wherein the first edge is a flat surface and the second edge has a first ridge and a second ridge spaced from and oriented generally parallel to the first ridge to form a groove therebetween.

4. The holder assembly of claim 1, further comprising:

a clip detachably connected to the rear wall of the holder for attaching the holder assembly to a wall, wherein the clip comprises a hook portion and a tabbed portion opposite the hook portion.

5. The holder assembly of claim 4, wherein the hook portion is coupled to the holder through an opening in the base of the holder.

6. The holder assembly of claim 4, wherein the tabbed portion protrudes past a lip of the rear wall of the holder.

7. The holder assembly of claim 1, further comprising at least one rectangular raised portion formed on a rear surface of the rear wall.

8. The holder assembly of claim 1, wherein the base has at least one opening for receiving a fastener.

9. The holder assembly of claim 8, wherein the fastener comprises a suction cup.

10. The holder assembly of claim 8, wherein the at least one opening has a small circular portion that opens into a larger circular portion.

11. The holder assembly of claim 1, further comprising a plurality of locking pins formed on the front wall and configured to releasably secure the container to the holder.

12. The holder assembly of claim 1, further comprising a plurality of ovaloid protrusions on a rear surface of the guide channel.

13. An assembly comprising:

a container comprising a housing and a lid connected to the housing, the lid comprising a flange extending around at least a portion of a perimeter of the lid;

a holder comprising a base, a front wall, a rear wall, and two side walls, the walls extending from the base at an oblique angle to form a cavity for receiving the container, the front wall having a guide channel for receiving the lid of the container; and a biasing member configured to bias contents of the holder towards the front wall, the biasing member comprising a support structure and an arm rotatably coupled to the support structure.

14. The assembly of claim 13, wherein the lid further comprises at least one tab spaced from and extending generally parallel to the flange to form a groove therebetween.

15. The assembly of claim 14, wherein the container is configured to be accommodated in the cavity and the lid is configured to be slidably engaged with the guide channel such that the at least one tab contacts a first surface of the guide channel and the flange contacts a second surface of the guide channel when the container is accommodated in the cavity.

16. The assembly of claim 13, wherein the guide channel has a first ridge and a second ridge spaced from and oriented generally parallel to the first ridge to form a groove therebetween.

17. The assembly of claim 13, wherein the guide channel comprises a first edge and a second edge of the front wall of the assembly, wherein the first edge is a flat surface and the second edge has a first ridge and a second ridge spaced from and oriented generally parallel to the first ridge to form a groove therebetween.

18. The assembly of claim 13, further comprising a clip detachably connected to the rear wall of the holder for attaching the assembly to an external surface.

* * * * *